US007126088B2

(12) United States Patent
Horton et al.

(10) Patent No.: US 7,126,088 B2
(45) Date of Patent: Oct. 24, 2006

(54) COOKING APPLIANCE CONTROL SYSTEM

(75) Inventors: Willard Henry Horton, Florence, SC (US); Kenneth E. Sauter, Goldsboro, NC (US); Marilyn L. Sterchi, Harrison, TN (US)

(73) Assignee: Maytag Corporation, Newton, IA (US)

( * ) Notice: Subject to any disclaimer, the term of this patent is extended or adjusted under 35 U.S.C. 154(b) by 189 days.

(21) Appl. No.: 10/952,747

(22) Filed: Sep. 30, 2004

(65) Prior Publication Data

US 2006/0070612 A1 Apr. 6, 2006

(51) Int. Cl.
*H05B 1/02* (2006.01)
*A21B 1/40* (2006.01)
*F27D 19/00* (2006.01)

(52) U.S. Cl. ..... 219/412; 219/492; 219/506; 99/327; 99/332; 99/342

(58) Field of Classification Search ..... None
See application file for complete search history.

(56) References Cited

U.S. PATENT DOCUMENTS 2,754,401 A 7/1956 Edelman
3,783,769 A 1/1974 Goodhouse et al.
3,819,112 A 6/1974 Goodhouse
3,837,568 A 9/1974 Goodhouse et al.
4,345,145 A 8/1982 Norwood
4,467,184 A * 8/1984 Loessel ..... 219/506
4,757,181 A 7/1988 Sakamoto et al.
4,894,518 A * 1/1990 Ishikawa et al. ..... 219/413
4,927,998 A 5/1990 Tamura et al.
5,432,321 A 7/1995 Gerl
5,693,245 A 12/1997 Clizbe
5,767,488 A 6/1998 Barger et al.
7,009,147 B1 * 3/2006 Schulte ..... 219/400

* cited by examiner

*Primary Examiner*—Joseph Pelham
(74) *Attorney, Agent, or Firm*—Diederiks & Whitelaw, PLC

(57) ABSTRACT

A control system for a cooking appliance enables a consumer to selectively program a cooking appliance through a control panel in a conventional mode based on established cooking times and temperatures, as well as in a simplified mode incorporating a minimal number of programming steps. In the simplified mode, the consumer selects a first, non-temperature related special features button and inputs a cook time. Immediately following input of the cook time, the control system starts a cooking operation. If the selected time is greater than a predetermined value, the control system automatically operates the cooking appliance in a cold start mode. An override is provided to disable the cold start mode if so desired. In addition, the control system allows a consumer to input both minimum and maximum cook times for the cooking operation.

21 Claims, 4 Drawing Sheets

SELECT COOK TIME
12:00
0:45
AUTO SET
Help
Favorites
Setup
Back
Space
Lock
Enter
TIMER2 On/Off
TIMER1 On/Off
UPPER OVEN
Bake
Broil
Convect
Clean
CANCEL
More Options
Oven Light
MAGIC COOK
LOWER OVEN
BAKE ELEMENT
BROIL ELEMENT
FAN
CONVECT HEATING ELEMENT
BUZZER
OVEN LIGHT
MEMORY
CPU
TEMP SENSORS
FAN SPEED SENSOR SELECT MIN TIME
START
AUTO SET
Help
Favorites
Setup
Back
Enter
Space
Lock
TIMER2 On/Off
TIMER1 On/Off
UPPER OVEN
Bake
Broil
Convect
Clean
CANCEL
More Options
Oven Light
MAGIC COOK
LOWER OVEN
BAKE ELEMENT
BROIL ELEMENT
FAN
CONVECT HEATING ELEMENT
BUZZER
OVEN LIGHT
MEMORY
CPU
TEMP SENSORS
FAN SPEED SENSOR SELECT MAX TIME
START
12:00
AUTO SET
Help
Favorites
Setup
TIMER2 On/Off
TIMER1 On/Off
UPPER OVEN
Bake
Broil
Convect
Clean
CANCEL
More Options
Oven Light
MAGIC COOK
LOWER OVEN
BAKE ELEMENT
BROIL ELEMENT
FAN
CONVECT HEATING ELEMENT
BUZZER
OVEN LIGHT
MEMORY
CPU
TEMP SENSORS
FAN SPEED SENSOR

COOKING APPLIANCE CONTROL SYSTEM

BACKGROUND OF THE INVENTION

1. Field of the Invention

The present invention pertains to the art of cooking appliances and, more particularly, to a cooking appliance including a control system having a simplified programming algorithm for initiating a cooking operation.

2. Discussion of the Prior Art

Over the years, there have been many advances in the art of cooking appliances. Various heat sources, such as convection air, microwave and IR heating elements have been used, in one way or another, to perform a cooking operation. Mechanical components such as switches, thermostats and other controls have been replaced, or at least supplemented, by electronic control systems. Rotary knobs are slowly giving way to touch pads and touch screen displays. Many new features have been added to the cooking appliance, such as preprogrammed operations, recipes, and multi-stage cooking operations. Many appliances include a help screen that aides a consumer in navigating through various available options. All in all, the construction and internal programming of the cooking appliance has grown to be more complicated. However, the basic steps for initiating a cooking operation have remained substantially unchanged over the years.

Typically, to initiate a cooking operation, a consumer may select a cooking mode, a cooking temperature, a cook time and a cook duration. In the most simplified form, the consumer may select the cook mode and cook temperature. The prior art contains several examples of cooking appliances that attempt to reduce an overall number of steps required to initiate a cooking operation. For example, U.S. Pat. No. 3,783,769 discloses a cooking appliance having a computer cooking means that, after placing a meat product into a cooking chamber, requires only an input indicating the type of meat and the degree of doneness before the cooking operation is started. While being simple, the process does not readily lend itself to other food items, such as baked goods and the like.

In addition, if a consumer desires to set a cook duration, he/she is limited to entering a single time. Most recipes call for performing a cooking operation over a range of cook times. Another consideration is that heating characteristics vary between cooking appliances. Where a food item will require heating for 30 minutes in one model, the same food item may require heating for 35 or even 40 minutes in a different model. For that reason, most recipes set forth both upper and lower limits for the cook time. Often times, a consumer will set a food item in the oven for the minimum time, only to find that the food item is not completely cooked. At that point, the food item is left in the oven for an additional time period which, if the timer is not set again or if the consumer simply looses track of the time, could lead to the food item becoming overcooked or even burned.

Based on the above, there exists a need for a cooking appliance requiring minimal inputs before initiating a cooking operation. In addition, there exists a need for a cooking appliance having a timer capable of setting both minimum and maximum cook time parameters. More specifically, given the sophistication provided by modern technology, the overall number of steps required to initiate a cooking operating could be further reduced, while not being limited by the particular type of food being cooked.

SUMMARY OF THE INVENTION

The present invention is directed to a control system for a cooking appliance which enables a consumer to perform a complete cooking operation with a minimal number of control inputs. In general, the invention enables a consumer to program the cooking appliance through a control panel in a conventional manner based on established cooking times and temperatures in accordance with recipes or other cooking instructions. However, under circumstances wherein the consumer would like to initiate a cooking process with a minimal number of steps after placing a food item into the appliance, a cooking operation can be started with just two, non-temperature related input parameters to the control system.

In accordance with the most preferred form of the invention, a special feature control button is provided on the control panel for the cooking appliance. The special feature button signals the control system that, after a cook time is inputted, a cooking operation should be automatically started. That is, the consumer need only press the special features button and input a cook time to initiate the cooking operation. In the most preferred embodiment, after the special feature button is selected and if the cook time is set above a minimum time period, e.g., 44 minutes, the control system will automatically initiate the cooking operation in a cold start mode. The cold start mode adjusts a temperature of the cooking appliance to establish a time-temperature relationship similar to that as if the cooking appliance went through a preheat cycle. In further accordance with the most preferred embodiment, the control system provides an override feature that, if a cold start is indicated, will allow the consumer to operate the cooking appliance in a standard mode. In the standard mode, the cooking appliance will initially perform a preheat cycle. Upon completion of the preheat cycle, the cooking appliance will provide a signal to the consumer that it is time to place the food item into an oven cavity of the cooking appliance.

In another embodiment, the consumer is presented with the option of inputting a single cook time or, alternatively, inputting both minimum and maximum cook times through the control panel. Prior to starting a cooking operation, the consumer can enter, such as through a timer pad, two cook times. A display portion of the control panel will prompt the consumer to first input a minimum cook time and, if so desired, a maximum cook time. Once the cooking operation has started, a timer will count down the time remaining for the minimum cook time. Once the minimum cook time has expired, a signal will indicate the cooking operation may be complete. If a maximum time is also selected, at the completion of the minimum cook time, the timer will count down the remaining time until the maximum cook time is compete.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
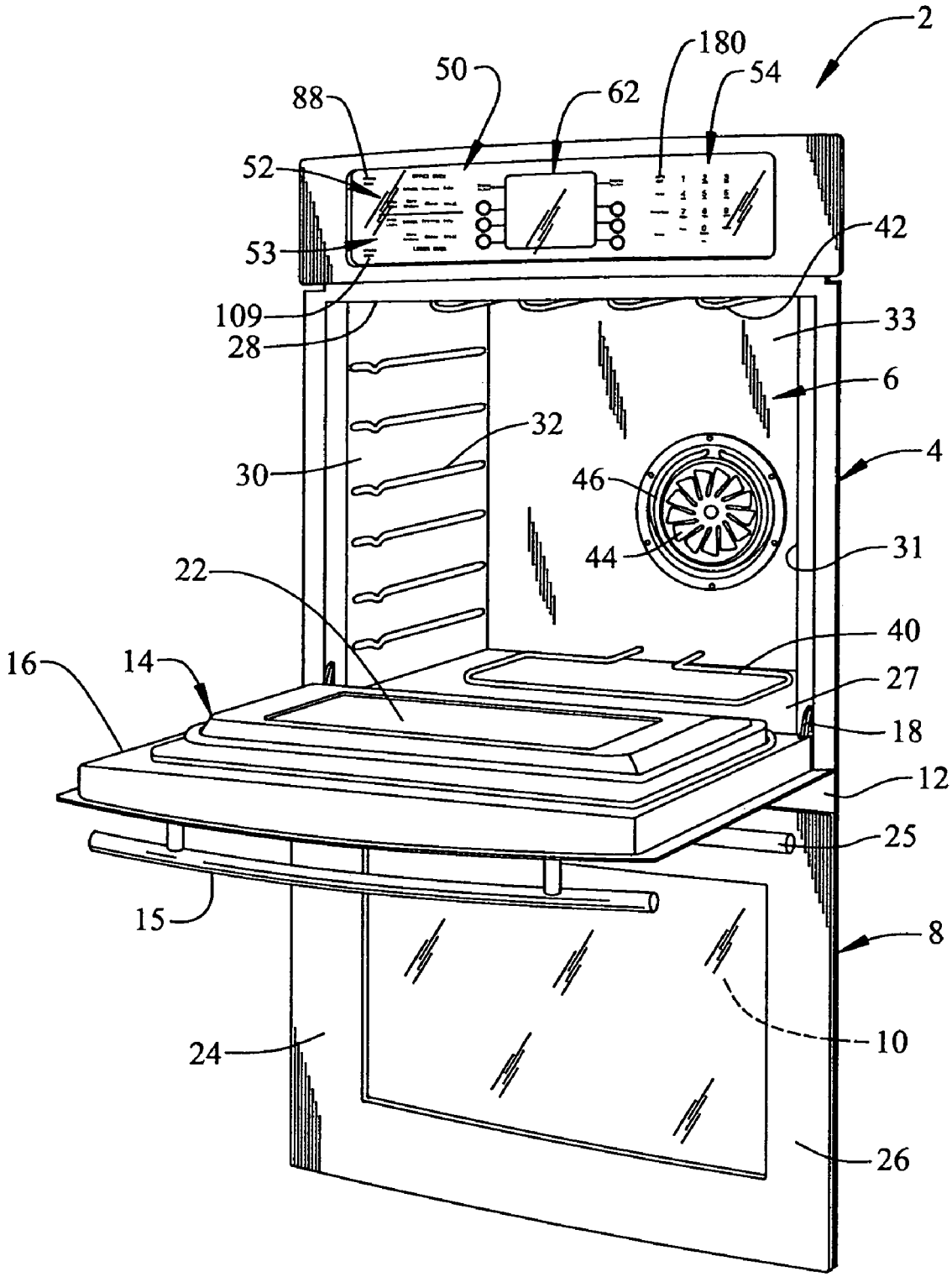
FIG. 1 is a perspective view of a wall oven constructed in accordance with the present invention.

With initial reference to FIG. 1, a cooking appliance constructed in accordance with the present invention is generally indicated at 2. Cooking appliance 2, as depicted, constitutes a double wall oven. However, it should be understood that the present invention not limited to this model type and can be incorporated into various types of oven configurations, e.g., cabinet mounted ovens, as well as both slide-in and free standing ranges. In any event, in the embodiment shown, cooking appliance 2 constitutes a dual oven wall unit including an upper oven 4 having upper oven cavity 6 and a lower oven 8 having a lower oven cavity 10. Cooking appliance 2 includes an outer frame 12 for supporting, at least in part, both upper and lower oven cavities 6 and 10.

In a manner known in the art, cooking appliance 2 is equipped with a door assembly 14 to selectively provide access to upper oven cavity 6. As shown, door assembly 14 includes a handle 15 at an upper portion 16 thereof. Door assembly 14 is adapted to pivot at a lower portion 18 to enable selective access to within oven cavity 6. In a manner also known in the art, door 14 is provided with a transparent zone or window 22 for viewing the contents of oven cavity 6 while door 14 is closed. In the embodiment shown, a corresponding door assembly 24 including a handle 25 and a transparent zone or window 26 is provided to selectively access lower oven cavity 10.

As best seen in FIG. 1, oven cavity 6 is defined by a bottom wall 27, an upper wall 28, opposing side walls 30 and 31 provided with a plurality of vertically spaced side rails 32, and a rear wall 33. In the preferred embodiment shown, bottom wall 27 is constituted by a flat, smooth surface designed to improve the cleanability of oven cavity 6. Arranged about bottom wall 27 of oven cavity 6 is a bake element 40. Also, a top broiler element 42 is arranged along upper wall 28 of oven cavity 6. Top broiler element 42 is provided to enable a consumer to perform a grilling process in upper oven 4 and to aid in pyrolytic heating during a self-clean operation. More specifically, both bake element 40 and top broiler element 42 are constituted by sheathed electric resistive heating elements.

Based on the above, in the preferred embodiment depicted, cooking appliance 2 actually constitutes an electric, dual wall oven. However, it is to be understood that cooking appliance 2 could equally operate on gas, either natural or propane. In any case, both oven cavities 6 and 10 preferably employ both radiant and convection heating techniques for cooking food items therein. To this end, rear wall 33 is shown to include a convection fan or blower 44. Although the exact position and construction of fan 44 can readily vary in accordance with the invention, in the embodiment shown, fan 44 draws in air at a central intake zone (not separately labeled) and directs the air into oven cavity 6 in a radial outward direction. As also clearly shown in this figure, another sheathed electric heating element 46, which preferably takes the general form of a ring, extends circumferentially about fan 44 in order to heat the radially expelled air flow. At this point, it should be noted that a fan cover, which has not been shown for the sake of clarity of the drawings, extends about fan 44 and heating element 46, preferably with the cover having an associated central inlet and a plurality of outer radial outlet openings.

Figure 2:
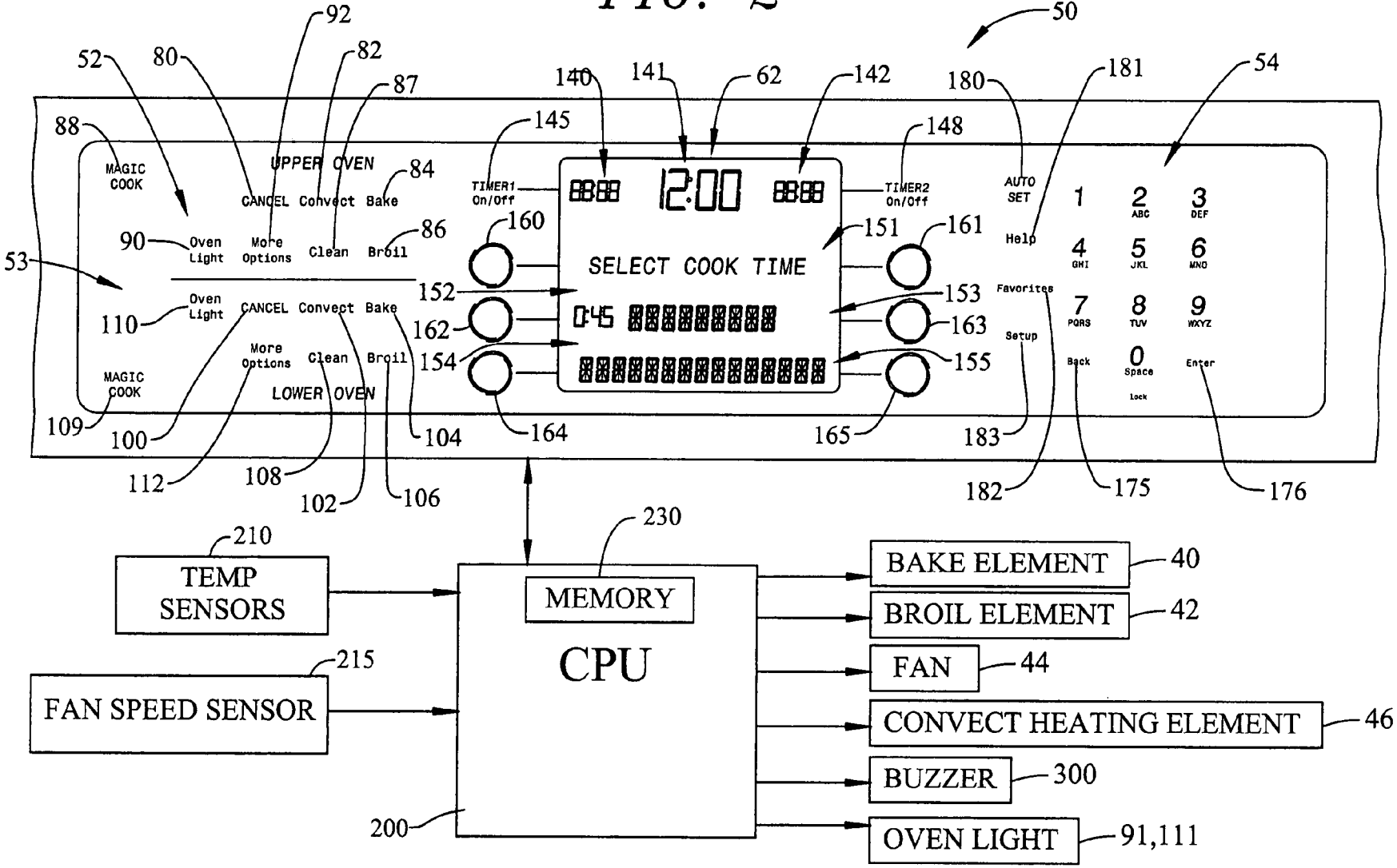
FIG. 2 is an enlarged view of a control panel employed in connection with the wall oven of FIG. 1 illustrating operation with a special feature button in accordance with a preferred embodiment of the present invention.

As further shown in FIGS. 1 and 2, cooking appliance 2 includes an upper control panel 50 having a plurality of control elements. In accordance with one embodiment, the control elements are constituted by first and second sets of oven control buttons 52 and 53, as well as a numeric pad 54. Control panel 50 is adapted to be used to input desired cooking parameters for cooking appliance 2. More specifically, the first and second sets of control buttons 52 and 53, in combination with numeric pad 54 and a display 62, enable a user to establish particular cooking operations for upper and lower ovens 4 and 8 respectively.

In one preferred embodiment particularly shown in FIG. 2, the first set of control buttons 52 includes a cancel button 80, a convection button 82, a bake button 84, a broil button 86, a clean button 87 and, as will be discussed more fully below, a special feature button 88 which is not related to any particular temperature setting for cooking appliance 2. In addition, first set of control buttons 52 also preferably includes an oven light button 90 for activating an oven light 91 associated with upper oven 4 and a button 92 used to access more cooking options which are conveyed to the user through display 62. In a corresponding manner, second set of control buttons 53 includes a cancel button 100, a convection button 102, a bake button 104, a broil button 106, a clean button 108 and a special features button 109. Furthermore, second set of control buttons 53 also preferably includes an oven light button 110 for activating an oven light 111 associated with lower oven 85, and a button 112 which is used to access more cooking options that are conveyed to the user through display 62.

Display 62 is preferably divided into various sections. In accordance with the most preferred embodiment of the invention, an uppermost section of display 62 is sub-divided into three time display zones 140–142. More specifically, leftmost display zone 140 constitutes a first timer zone having an associated timer button 145. Central display zone 141 constitutes a clock for cooking appliance 2. Rightmost display zone 142 constitutes a second timer zone having an associated timer button 148.

Spaced below time display zones 140–142 are a series of vertically spaced information display zones 151–155. Each of information display zones 151, 153 and 155 has associated left and right portions (not separately labeled). As shown, each of the left and right portions have associated therewith laterally positioned selection buttons 160–165. As also shown, numeric pad 54 preferably enables alpha-numeric input. That is, in addition to presenting numbers 0–9, numeric pad 54 doubles as an input source for alpha information. To this end, in a manner somewhat analogous to a telephone keypad, the number 2 button functions for ABC letter entry; the number 3 button functions for DEF letter entry; the number 4 button functions for GHI letter entry; the number 5 button functions for JKL letter entry; the number 6 button functions for MNO letter entry; the number 7 button functions for PQRS letter entry; the number 8 button functions for TUV letter entry; and the number 9 button functions for WXYZ letter entry. The number 0 button can also be used to input a space. On either side of the number 0 button are Back and Enter buttons 175 and 176 which can be used in combination with the various alpha keys for information entry. Finally, provided adjacent numeric pad 54 are auto set, Help, Favorites and Setup buttons 180–183.

In general, control panel 50 is linked to a controller or CPU 200 formed as part of an overall control system for cooking appliance 2. Therefore, CPU 200 receives user inputs and selections through control panel 50, as well as signals from sensors associated with cooking appliance 2, i.e. oven temperature sensors for upper and lower ovens 4 and 8 as generally indicated at 210 and a fan speed sensor 215. In turn, CPU 200 controls bake element 40, top broiler element 42, convection fan 44 and convection heating element 46 for upper oven cavity 6. Of course, a corresponding control is available for lower oven cavity 10. CPU 200 is also equipped with a memory module 230 for storing information associated with operating cooking appliance 2. In any event, since the various programming and general operational characteristics of cooking appliance 2 do not form part of the present invention, these features will not be discussed further here. Instead, the present invention is particularly directed to the operation of the control system for cooking appliance 2.

In accordance with the preferred embodiment of the present invention, cooking appliance 2 is operable in a first or standard mode and a second or special feature mode. In the standard mode, in order to initiate a cooking operation, a consumer would select a cooking process, such as bake and/or convection cooking through control elements 82 and/or 84, input a temperature through numeric pad 54 and select a cook time and duration through, for example, timer button 145 in a manner known in the art. Alternatively, the consumer may, in accordance with the present invention, initiate a cooking operation through a simple two step procedure. That is, in accordance with the most preferred form of the present invention, selection of special feature button 88 allows the consumer to initiate a cooking operation by simply inputting a cook time as detailed below.

As represented in FIG. 2, after special feature button 88 is selected, display 62 will, preferably on line 151, prompt the consumer to select a cook time parameter. At this point, the consumer inputs a cook time parameter through, for example, numeric pad 54, or by repeated actuation of auto set button 180. Activation of auto set button 18 increments the time displayed on line 153 in predetermined time intervals, for example 15 minute intervals. Alternatively, the consumer could add or subtract to the cook time through manipulation of slew buttons, i.e., up/down timer buttons (not shown) or through timer button 145. In any event, immediately after inputting the desired cook time, CPU 200 automatically actuates at least one of heating elements 40, 42 and 46 to initiate a cooking operation. In accordance with the most preferred embodiment, cooking appliance 2 will initiate a bake mode at a predetermined temperature (e.g. 350 or 400° F.). Once the cooking operation has commenced, the consumer has the option to, if so desired, add convection cooking to the process by selecting button 82. In addition, if at any time during the cooking operation the consumer desires to adjust a temperature of the oven, the consumer can simply press auto set button 180 and input the desired temperature through key pad 54. Furthermore, if adjustment of the time parameter is desired, special features button 88 can be actuated which then prompts the consumer to select or adjust the desired cook time.

In further accordance with the preferred embodiment, CPU 200 will automatically initiate a cold start cooking operation in the event the selected time parameter exceeds a minimum value, for example 44 minutes. In general, the cold start mode automatically adjusts a temperature of oven cavity 6 during a first portion of the cooking cycle to allow for cooking from a cold start. The adjustment is accomplished by increasing a temperature in the oven cavity so as to provide a food item with the same time/temperature relationship that would be experienced if the food item where placed in oven cavity 6 after a preheat period. The general operation of the cold start mode is not considered part of the present invention and is actually described in detail in co-pending U.S. patent application Ser. No. 10/301,579 entitled "COLD START COOKING SYSTEM", filed Nov. 22, 2002 and incorporated herein by reference.

The cold start feature preferably includes an override that directs CPU 200 to perform a cooking operation wherein oven cavity 6 is preheated and thereafter oven cavity 6 is maintained at a substantially constant temperature throughout the cooking operation. In accordance with one aspect of the invention, overriding the cold start operation is accomplished by activating and holding special feature button 88 for a predetermined period, e.g., three seconds. At this point, CPU 200 will respond with a signal, which could be both audible and visual, indicating that the cold start mode is de-selected. In order to reactivate the cold start feature, the consumer would once again simply press and hold special feature button 88 for a second predetermined period, again preferably about three seconds. When the cold start mode is deactivated, CPU 200 performs a preheat cycle for oven cavity 6. At the termination of the preheat cycle, CPU 200 will provide a signal to the user which, in the most preferred form of the invention, will include an audible signal through activation of a piezoelectric electric buzzer 300 and a visual signal, such as by flashing oven light 91 while providing a prompt on display 62.

Figure 3:
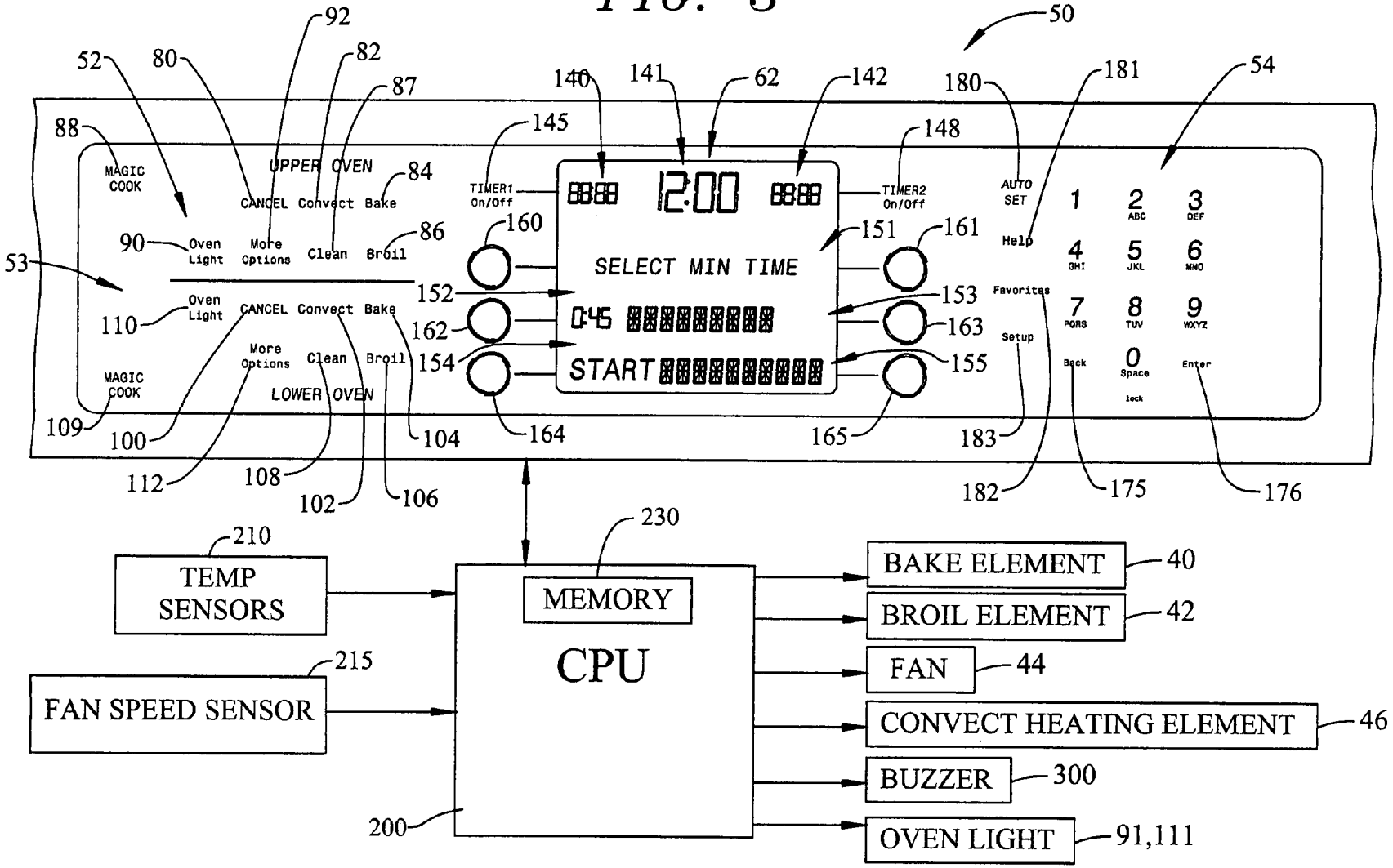
FIG. 3 is an enlarged view of the control panel employed in connection with the wall oven of FIG. 1, illustrating selection of a minimum cook time in accordance with another aspect of the present invention.
Figure 4:
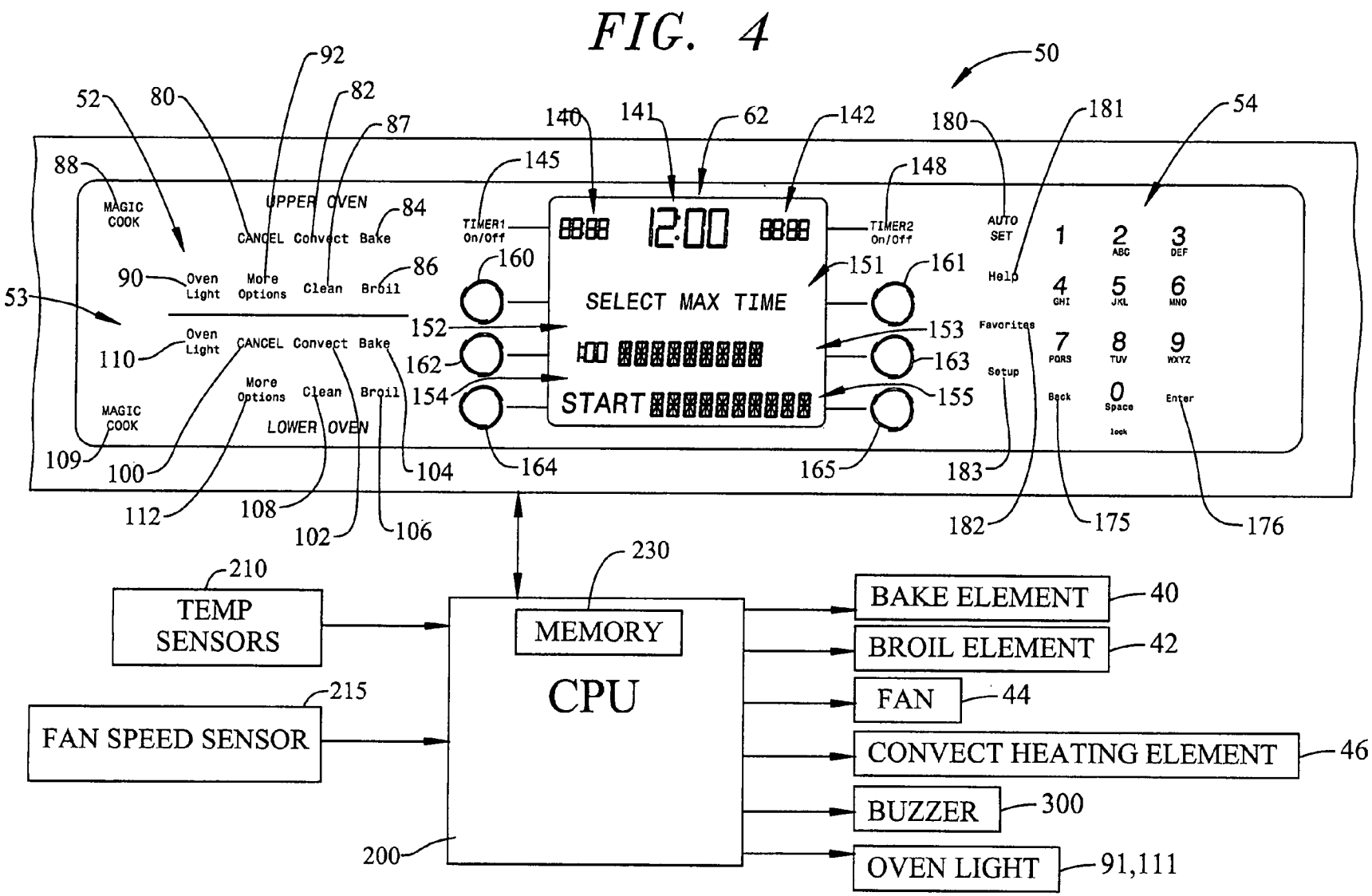
FIG. 4 is an enlarged view of the control panel employed in connection with the wall oven of FIG. 1, illustrating selection of a maximum cook time in accordance with the present invention.

In accordance with another aspect of the present invention as represented in FIGS. 3 and 4, the consumer can be presented with the option of inputting two cook times through control panel 50. That is, as many of today's recipes call for cooking over a range of cook times, cooking appliance 2 enables the consumer to input both a minimum cook time and a maximum cook time through control panel 50. After selecting a particular cooking process, such as through button 84, display 62 prompts the consumer to select a minimum cook time (FIG. 3). Through manipulation of for example, timer button 145, key pad 54 or auto set button 180, a minimum cook time parameter is input into CPU 200. After the minimum cook time is set, the consumer is prompted to select a maximum cook time (FIG. 4). For instance, display 62 can scroll to prompt a maximum cook time. At this point, a maximum cooking time parameter can be entered in a manner similar to that described above. In accordance with this feature, the consumer can choose not to enter a maximum cook time. In this situation, the consumer can simply press button 160 to bypass inputting the maximum cook time, followed by pressing button 164 to start the cooking operation. That is, the consumer can "pass over" selecting a maximum cook time by depressing button 160 when prompted to input the maximum time parameter.

In any event, after the cooking operation has started, timer 140 begins to count down the time remaining for the minimum cook time. Once timer 140 has counted down to zero, a signal will be provided by CPU 200, such as in the form of a beep through a piezoelectric buzzer 300 and/or through display 62, indicating the termination of the minimum cook time. At this point, if a maximum cook time was set, timer 140 begins to count down the difference between the minimum cook time and the time remaining for the maximum cook time. At any time, the consumer has the option of terminating the cooking process or allowing the maximum cook time to expire, at which point CPU 200 will deactivate the heating element(s). In a manner similar to that described above, upon termination of the maximum cook time, a signal is provided to the consumer.

In general, the control system of the present invention enables a consumer to activate a cooking operation through various modes. That is, a consumer can initiate a standard cook mode, a simplified cook mode or perform a cooking operation over a range of cook times such that a versatile control system is employed for the cooking operation. Although described with reference to a preferred embodiment of the present invention, it should be readily apparent to one of ordinary skill in the art that various changes and/or modifications can be made to the invention without departing from the spirit thereof. For instance, the particular title descriptions of the various control buttons have been presented for exemplary purposes only and various other titles could be employed. In addition, while the invention is described with regard to upper oven 4, it should be readily apparent that the present invention is equally applicable to lower oven 6, particularly through the use of special feature button 109. In general, the invention is only intended to be limited by the scope of the following claims.

We claim:

1. A cooking appliance comprising:

an oven cavity including top, bottom, rear and opposing side walls;

a door pivotally mounted for movement relative to the oven cavity for selectively closing the oven cavity;

at least one heating element positioned to direct heat into the oven cavity;

means for establishing a non-temperature related cooking parameter for a cooking operation;

means for inputting at least one time parameter for the cooking operation, said at least one time parameter including both minimum and maximum cooking times for the cooking operation; and control means for selectively activating the at least one heating element to perform the cooking operation in the oven cavity based upon requiring only the non-temperature related cooking parameter and the at least one time parameter, wherein said control means provides a signal upon termination of the minimum cooking time.

2. A cooking appliance comprising:

an oven cavity including top, bottom, rear and opposing side walls;

a door pivotally mounted for movement relative to the oven cavity for selectively closing the oven cavity;

at least one heating element positioned to direct heat into the oven cavity;

means for establishing a non-temperature related cooking parameter for a baking operation;

means for inputting at least one time parameter for the baking operation; and control means for selectively activating the at least one heating element to perform the baking operation in the oven cavity based upon requiring only the non-temperature related cooking parameter and the at least one time parameter.

3. The cooking appliance according to claim 2, further comprising:

means for selectively setting a temperature parameter after initiation of the baking operation.

4. The cooking appliance according to claim 2, further comprising:

means for selectively adjusting the at least one time parameter after initiation of the baking operation.

5. The cooking appliance according to claim 2, wherein said control means initiates the baking operation in a cold start mode automatically if the at least one time parameter exceeds a predetermined value.

6. The cooking appliance according to claim 5, further comprising: means for overriding the cold start mode whereupon said control means signals a user to introduce a food item into the oven cavity after a preheat period.

7. The cooking appliance according to claim 6, wherein said at least one time parameter includes both minimum and maximum cooking times.

8. The cooking appliance according to claim 7, further comprising:

means for bypassing an entry of the maximum cooking time whereupon the control means initiates the baking operation based on the minimum cooking time.

9. The cooking appliance according to claim 2, wherein the control means automatically establishes a temperature parameter for the baking operation without entry of a temperature parameter by a user.

10. A cooking appliance comprising:

an oven cavity including top, bottom, rear and opposing side walls;

a door pivotally mounted for movement relative to the oven cavity for selectively closing the oven cavity;

at least one heating element positioned to direct heat into the oven cavity;

means for establishing a non-temperature related cooking parameter for a cooking operation;

means for inputting at least one time parameter for the cooking operation, said at least one time parameter including both minimum and maximum cooking times for the cooking operation; and control means for selectively activating the at least one heating element to perform the cooking operation in the oven cavity based upon requiring the non-temperature related cooking parameter and the at least one time parameter, wherein said control means provides a signal upon termination of the minimum cooking time.

11. The cooking appliance according to claim 10, further comprising: means for selectively adjusting at least one of the minimum and maximum time parameters after initiation of the cooking operation.

12. The cooking appliance according to claim 10, further comprising: means for bypassing an entry of the maximum cooking time whereupon the control means initiates the cooking operation based on the minimum cooking time.

13. The cooking appliance according to claim 10, wherein the control means automatically establishes a temperature parameter for the cooking operation without entry of a temperature parameter by a user.

14. A method of performing a baking operation in a cooking appliance having an oven cavity, at least one heating element and a control unit comprising:

selecting a non-temperature related cooking parameter;

inputting at least one time parameter;

activating the at least one heating element through the control unit based solely on the non-temperature related cooking parameter and the at least one time parameter; and terminating activation of the at least one heating element based upon the at least one time parameter.

15. The method of claim 14, further comprising: selectively setting a temperature parameter after initiation of the baking operation.

16. The method of claim 14, wherein inputting the at least one time parameter includes inputting both minimum and maximum cook times for the baking operation.

17. The method of claim 16, further comprising: bypassing an entry of the maximum cooking time whereupon the baking operation is initiated based on the minimum cooking time.

18. The method of claim 14, further comprising: selectively adjusting the at least one time parameter after initiation of the baking operation.

19. The method of claim 14, further comprising: automatically initiating the baking operation in a cold start mode if the at least one time parameter exceeds a predetermined value.

20. The method of claim 19, further comprising:

overriding the cold start mode to establish a preheat mode; and signaling a user to introduce a food item into the oven cavity after a preheat period.

21. The method of claim 14, further comprising: automatically establishing a temperature parameter for the baking operation without entry of a temperature parameter by a user.

* * * * *